US010124265B2

(12) United States Patent
Hu et al.

(10) Patent No.: US 10,124,265 B2
(45) Date of Patent: Nov. 13, 2018

(54) ENTERTAINMENT-ORIENTED MULTI-MODE EXPERIENCE SYSTEM

(71) Applicant: DALIAN WANDA GROUP CO., LTD., Dalian (CN)

(72) Inventors: Zhanghong Hu, Beijing (CN); Yuan Wang, Beijing (CN); Yong Mei, Beijing (CN); Hengsheng Fu, Beijing (CN); Miao Wang, Beijing (CN); Chuzhu Feng, Beijing (CN)

(73) Assignee: DALIAN WANDA GROUP CO., LTD., Dalian (CN)

( * ) Notice: Subject to any disclaimer, the term of this patent is extended or adjusted under 35 U.S.C. 154(b) by 0 days.

(21) Appl. No.: 15/737,077

(22) PCT Filed: Jul. 15, 2015

(86) PCT No.: PCT/CN2015/084039
§ 371 (c)(1),
(2) Date: Dec. 15, 2017

(87) PCT Pub. No.: WO2016/201755
PCT Pub. Date: Dec. 22, 2016

(65) Prior Publication Data

US 2018/0229129 A1 Aug. 16, 2018

(30) Foreign Application Priority Data

Jun. 18, 2015 (CN) ..... 2015 1 0340589

(51) Int. Cl.
*A63G 31/16* (2006.01)
*A63G 21/04* (2006.01)
(Continued)

(52) U.S. Cl.
CPC ..... *A63G 21/04* (2013.01); *A63G 7/00* (2013.01); *A63G 21/06* (2013.01); *A63G 31/02* (2013.01); *A63J 5/025* (2013.01)

(58) Field of Classification Search
CPC ..... A63G 31/00; A63G 31/02; A63G 31/04; A63G 31/06; A63G 31/16; G09B 9/00;
(Continued)

(56) References Cited

U.S. PATENT DOCUMENTS 7,905,790 B2 * 3/2011 Schnuckle ..... A63J 1/02 472/43
8,021,236 B2 * 9/2011 Bloom ..... A63F 9/02 124/41.1
(Continued)

FOREIGN PATENT DOCUMENTS

CN 102725040 A 10/2012
CN 202715234 U 2/2013
(Continued)

OTHER PUBLICATIONS

Office Action dated Sep. 26, 2016 in Chinese Application No. 201510340589.4.
(Continued)

*Primary Examiner* — Kien Nguyen
(74) *Attorney, Agent, or Firm* — Dilworth IP, LLC

(57) ABSTRACT

Disclosed is an entertainment-oriented multi-mode experience system featuring a closed rail and a riding vehicle traveling along the closed rail. A screen rail is provided at the side of the closed rail. A screen synchronous moving mechanism corresponding to the riding vehicle and capable of traveling is provided on the screen rail. The screen synchronous moving mechanism includes a rotary support device and a traveling device. A screen is installed on the top of the rotary support device and is capable of performing a 180°
(Continued)

pitching motion via a pitch axis, and the rotary support device is installed on the traveling device and is capable of performing a 360° rotation in a horizontal plane. The traveling device can travel along with the riding vehicle synchronously on the screen rail.

9 Claims, 6 Drawing Sheets

(51) Int. Cl.

| | |
|---|---|
| ***A63J 5/02*** | (2006.01) |
| ***A63G 21/06*** | (2006.01) |
| ***A63G 7/00*** | (2006.01) |
| ***A63G 31/02*** | (2006.01) |
| *G09B 9/00* | (2006.01) |

(58) Field of Classification Search
CPC ... G09B 9/02; G09B 9/04; G09B 9/08; G09B 9/14; G09B 9/165; G09B 19/00
USPC ..... 472/2, 43, 59–61, 130; 434/29, 33–35, 434/37, 55
See application file for complete search history.

(56) References Cited

U.S. PATENT DOCUMENTS

| | | | | |
|---|---|---|---|---|
| 8,179,337 | B2 * | 5/2012 | Wilzbach | A63G 7/00 104/53 |
| 8,375,863 | B2 * | 2/2013 | Roodenburg | A63G 7/00 104/53 |
| 8,727,896 | B2 * | 5/2014 | Frolov | A63G 7/00 472/13 |
| 9,278,292 | B2 * | 3/2016 | Vance | A63G 31/16 |
| 2009/0084285 | A1 | 4/2009 | Verl et al. | |
| 2010/0053029 | A1 | 3/2010 | Wilzbach et al. | |
| 2015/0157351 | A1 * | 6/2015 | Seegert | A61B 17/322 606/132 |

FOREIGN PATENT DOCUMENTS

| | | | |
|---|---|---|---|
| CN | 103212205 | A | 7/2013 |
| CN | 104225922 | A | 12/2014 |
| CN | 204215700 | U | 3/2015 |
| CN | 104537968 | A | 4/2015 |
| CN | 204745632 | U | 11/2015 |
| JP | H05161762 | A | 6/1993 |
| JP | H11015248 | A | 1/1998 |
| WO | 2011068566 | A1 | 6/2011 |
| WO | 2014063250 | A1 | 5/2014 |
| WO | 2015071693 | A1 | 5/2015 |

OTHER PUBLICATIONS

Office Action dated Mar. 13, 2017 in Chinese Application No. 201510340589.4.
PCT International Search Report and Written Opinion dated Mar. 11, 2016 from corresponding Application No. PCT/CN2015/084039, 11 pages.

* cited by examiner

Before reversal of the dome screen

After reversal of the dome screen

ENTERTAINMENT-ORIENTED MULTI-MODE EXPERIENCE SYSTEM

FIELD OF THE INVENTION

The present disclosure generally relates to amusement systems, and more particularly, to amusement-oriented multi-mode experience systems.

BACKGROUND OF THE INVENTION

Nowadays, the rails of entertainment projects, such as dark rides and roller coasters, are usually single-closed rails, and tourists can only have the experience in a single fixed line. Even for few dual-rail roller coasters, the two rails do not essentially cross or join and are actually two parallel rails, and the running parameters of riding vehicles traveling on these two rails, such as speed, acceleration, etc., are very close, and thus different types of experience cannot be provided. In addition, the dark rides or indoor roller coasters in prior art usually employ fixed scenes, i.e. screens are disposed on some scenes to display dynamic scenarios. The riding vehicle will stop for a period of time upon arriving to the screen and will continue to move after the tourists watch the movies. The above-mentioned ways of fixed screens require the riding vehicle to stop, which is difficult to meet the tourists' demands for watching movies during the traveling process.

SUMMARY OF THE INVENTION

The purpose of the present disclosure is to provide an amusement-oriented multi-mode experience system. By using the experience system, tourists can watch movies and play games when the riding vehicle is moving.

An amusement-oriented multi-mode experience system of the present disclosure comprises a closed rail, and a riding vehicle traveling along the closed rail. A screen rail is provided at the side of the closed rail. A screen synchronous moving mechanism corresponding to the riding vehicle and capable of traveling is provided on the screen rail. The screen synchronous moving mechanism comprises a rotary support device and a traveling device. The rotary support device is installed with a screen on the top thereof. The screen is installed on the top of the rotary support device and is capable of performing a 180° pitching motion via a pitch axis. The rotary support device is installed on the traveling device and is capable of performing a 360° rotation in a horizontal plane. The traveling device can travel along with the riding vehicle synchronously on the screen rail.

The screen rail may be in a closed shape or in a linear shape, and is in parallel with the closed rail.

The screen rail is in a straight line shape and is disposed within the closed rail.

The screen is a straight screen, an arc screen, a dome screen, an irregular screen or a fog screen.

The riding vehicle comprises a wheel-type chassis adapted for traveling along the rail and a cabin mounted on the wheel-type chassis.

Optionally, the cabin is rotatably and retractably mounted on the wheel-type chassis via a support equipment.

In one embodiment, the closed rail comprises a stimulating section and a non-stimulating section.

A rail switching device is mounted at a bifurcation and an intersection of the stimulating section and the non-stimulating section, the rail switching device includes a straight rail, a curve rail, a connector, a slide rail and a driving and controlling device, which can be assembled together into one piece being capable of lateral motion as a whole.

A static scene and a dynamic scene are disposed on a side of the rail according to the originality of a theater.

The experience system of the present disclosure incorporates different experience modes, and combines different experience lines and different movie-watching ways. The combination of different lines and different movie-watching ways can provide the tourists with a rich experience of multiple modes. In a single entertainment project, tourists can choose an exciting roller coaster line or a mild changing rail line, the tourists can watch movies on screens or interact when the riding vehicle stops or is traveling.

DETAILED DESCRIPTION OF THE INVENTION

Figure 1:
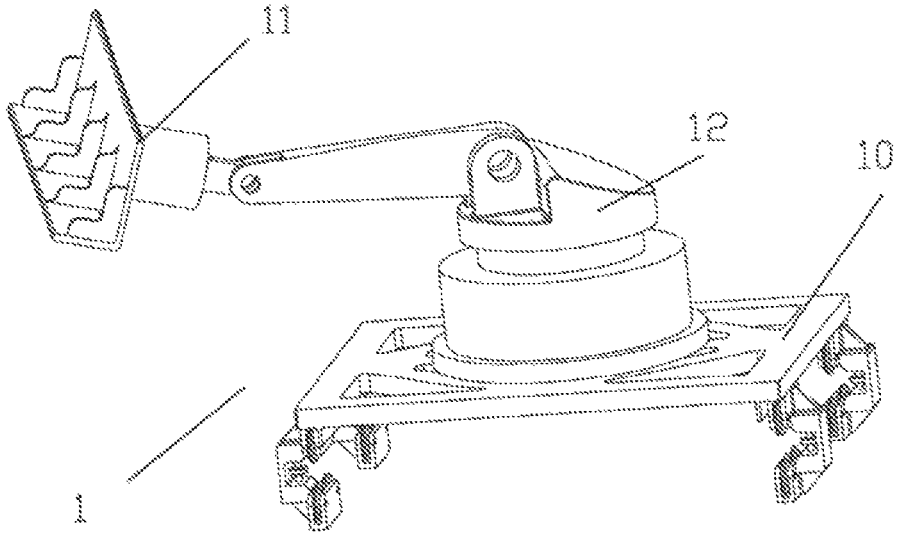
FIG. 1 is a perspective schematic view of a single riding vehicle according to the present disclosure.

Specific embodiments of the present disclosure will be described in details below by referring to the drawings.

The amusement-oriented multi-mode experience system according to the present disclosure comprises a riding vehicle 1, a rail 2, a screen 3, a screen rail 4 and a screen synchronous moving mechanism 5, wherein, The riding vehicle 1 is used for carrying tourists, and may move on the fixed rail 2 by employing a wheel-type chassis 10, and each riding vehicle 1 may carry several tourists. A tourist cabin 11 may be directly fixed on the wheel-type chassis 10, or may be connected to the wheel-type chassis 10 via a support equipment 12 (such as a multi-degree-of-freedom motion platform, an industrial robot arm, etc.) as shown in FIG. 1. The riding vehicle 1 is either automatically driven by an on-board equipment, or driven by an external equipment, such as a friction wheel, a synchronous linear motor, etc. Since the connection between the riding vehicle 1 and the rail 2 can be achieved by conventional technologies, it will not be described in details herein.

Figure 2:
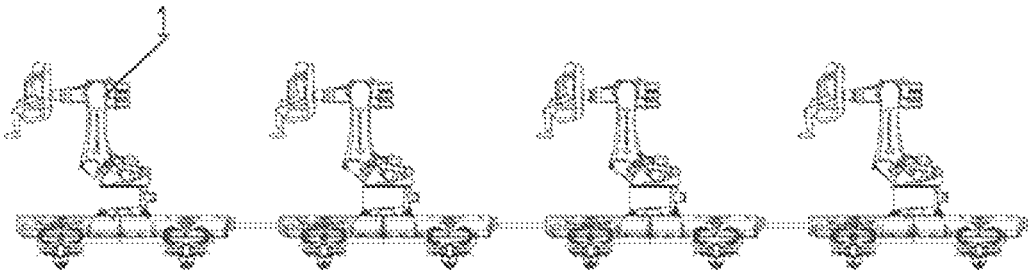
FIG. 2 is a structural schematic view of several riding vehicles jointed together according to the present disclosure.

Each riding vehicle 1 may either travel independently, or be connected in a line, and travel as a train, as shown in FIG. 2.

Figure 3:
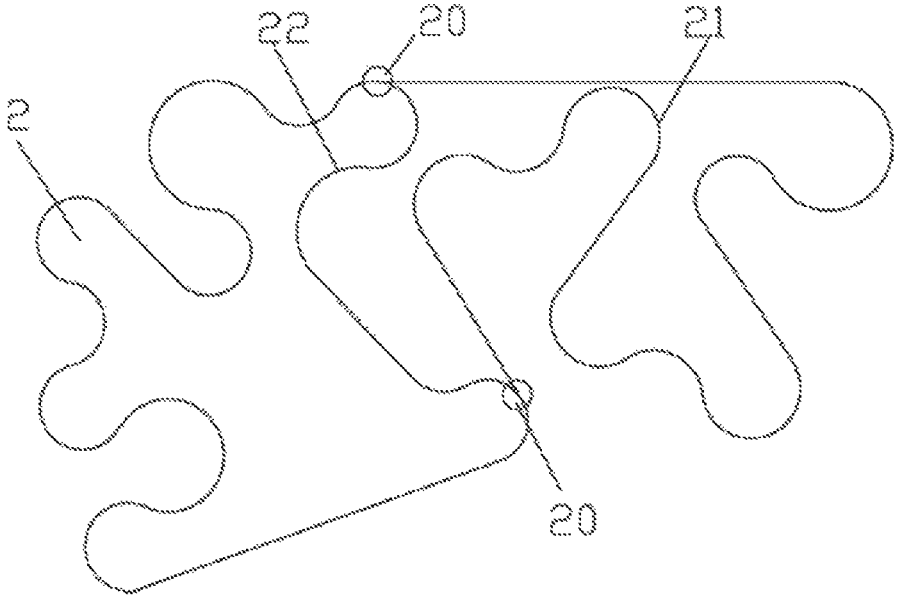
FIG. 3 is a structural schematic view of a rail according to the present disclosure.
Figure 4:
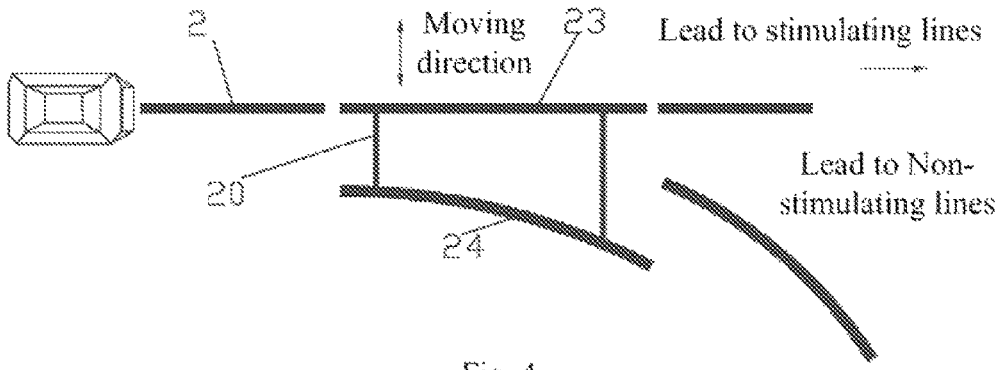
FIG. 4 is an operating principle schematic view of a rail switching device according to the present disclosure.
Figure 5:
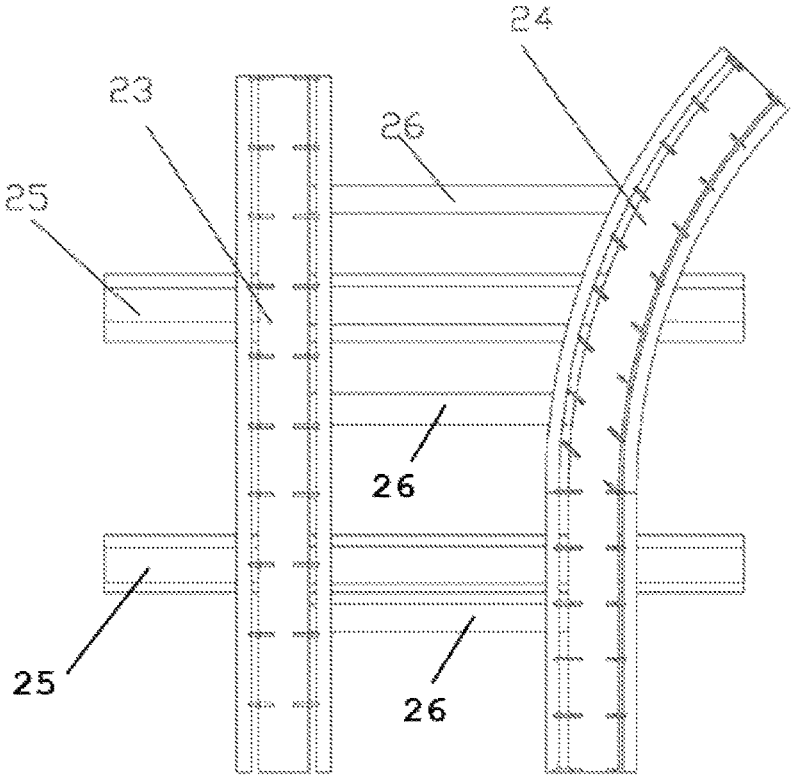
FIG. 5 is a structural schematic view of a rail switching device according to the present disclosure.

The rail 2, either in a closed shape or in a linear shape, comprises a stimulating section 21 and a non-stimulating section 22, as shown in FIG. 3. The rail of the stimulating section 21 fluctuates significantly, which brings a great change of the velocity and the angular velocity to the riding vehicle 1. The rail of the non-stimulating section 22 does not have significant ups and downs, so that the riding vehicle 1 may travel in a constant velocity along the non-stimulating section 22. Rail switching devices 20 are mounted at a bifurcation and an intersection of the stimulating section 21 and the non-stimulating section 22. As shown in FIGS. 4 and 5, the rail switching device 20 includes a straight rail 23, a curve rail 24, a connector 26, a slide rail 25, and a driving and controlling device including a linear motor, and the rail switching device 20 can move laterally as a whole. When the left end of the straight rail 23 is connected to the present rail, the riding vehicle 1 can be directed to the stimulating section 21 via the rail switching device 20; and when the left end of the curve rail 24 is connected with the present rail, the riding vehicle 1 can be directed to the non-stimulating section via the rail switching device 20. The structures of the straight rail 23 and the curve rail 24 are similar to that of roller coaster rail, and the straight rail 23 and the curve rail 24 can move as a whole after being connected by the connectors 26. The straight rail 23, the curve rail 24 and the connectors 26 are mounted on a slide rail 25, and a linear motor and its actuator are also mounted thereon for controlling the movement of the rail switching device 20. The distribution of riding vehicles in different experience lines of the experience system can also be controlled by controlling the position of the rail switching device 20. The rails of the experience system may also employ network lines formed by several stimulating sections and several non-stimulating sections, so as to provide tourists with rich multi-mode experience.

Specific scenes, including static scenes and dynamic scenes, are disposed on both sides of the rail 2 according to the originality of a theater. The static scenes are mainly indoor decorations, and the dynamic scenes may be generated by controllable and movable performance props.

Figure 6:
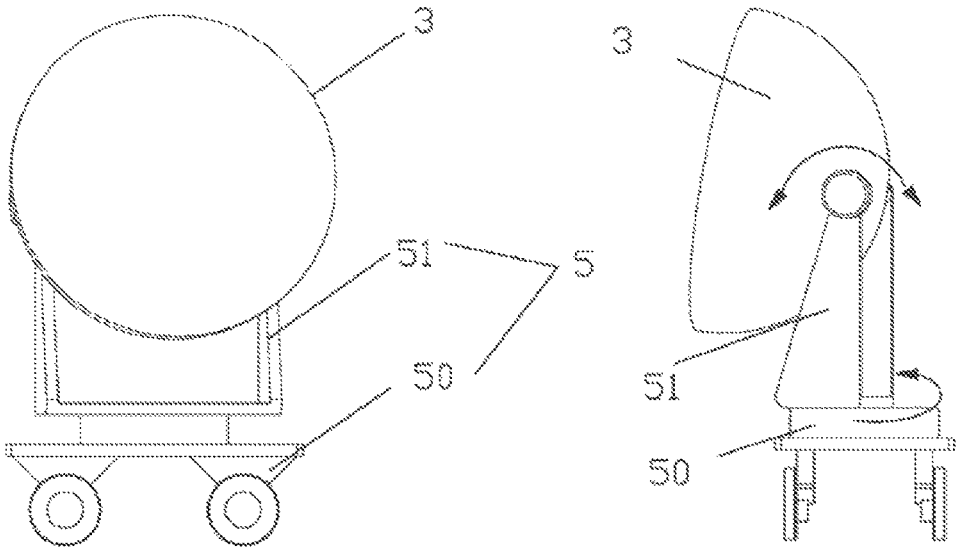
FIG. 6 is a structural schematic view of a screen synchronous moving mechanism according to the present disclosure, a front view and a side view of the screen synchronous moving mechanism are shown therein.
Figure 7:
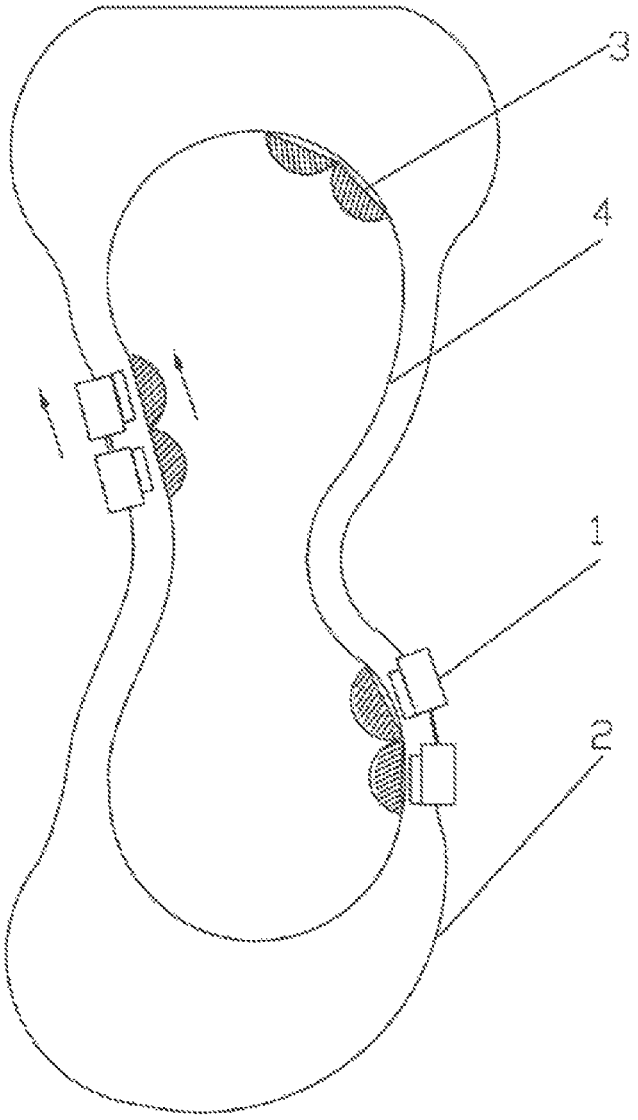
FIG. 7 is a schematic view of the distribution of the riding vehicles and screens according to the present disclosure.
Figure 8:
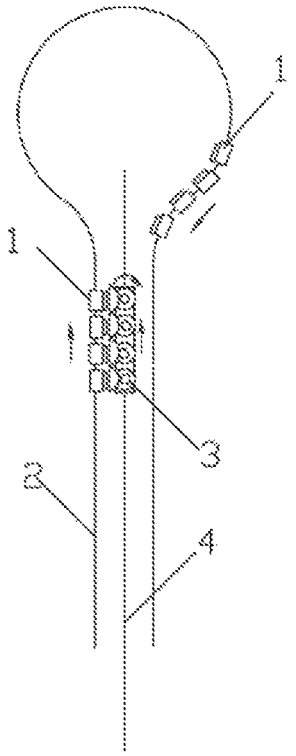
FIG. 8 is a second schematic view of the distribution of the riding vehicles and screens according to the present disclosure.
Figure 8:
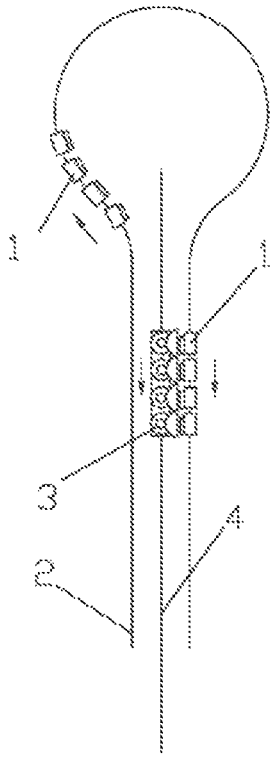

As shown in FIG. 7 and FIG. 8, a screen rail 4 is provided at the side of the rail 2. The screen rail 4, either in a closed shape or in a linear shape, is parallelly provided at the side of the rail 2. A screen synchronous moving mechanism 5 corresponding to the riding vehicle 1 and capable of traveling is provided on the screen rail 4. As shown in FIG. 6, the screen synchronous moving mechanism 5 comprises a rotary support device 51 and a traveling device 50, and the traveling device 50 can travel synchronously with the riding vehicle 1 along the screen rail 4. The rotary support device 51 is installed with a screen 3 on the top thereof. The screen 3 is installed on the top of the rotary support device 51 and is capable of performing a 180° pitching motion via a pitch axis, such that the screen 3 can revert or maintain a certain posture. Meanwhile, the rotary support device 51 is installed on the traveling device 50 and is capable of performing a 360° rotation in a horizontal plane.

The screens 3 include straight screens, arc screens, dome screens, irregular screens, fog screens, etc. Different types of screens are seamlessly combined with peripheral scenes for displaying specific movies. The tourists can watch movies or interact with elements in the movies.

The screen synchronous moving mechanisms 5 can either stay still or travel around. When a riding vehicle travels to a position in front of the screen 3, it can either stop before the still screen 3 for watching videos or images, or travel synchronously with the screen 3, so as to provide the function that the tourists can watch videos or images during the traveling process.

The screen rail 4, which is usually located in the same horizontal plane with the rail 2, can be designed into any shape. However, in the synchronous traveling sections, the screen rail 4 is required to be matching with the rail 2 along which the riding vehicle 1 is traveling. The screen traveling device 50 can travel along the screen rail 4 for supporting the screen 3 or adjusting the posture and position of the screen 3. When the riding vehicle 1 gets close to the screen 3, the screen traveling device 50 travels synchronously with the riding vehicle 1, and adjusts the position and posture of the screen 3, such that the screen 3 is always in front of the tourists during the traveling process to ensure the immersive feeling of the tourists. The riding vehicle 1 and the screen traveling device 50 of the screen 3 move apart after a period of time of synchronous traveling, and continue to travel along their own rails respectively, and the screen 3 may synchronously travel with another riding vehicle 1 at the next moment. The screen rail 4 may be a closed rail in any shape, or may be a non-closed rail. The screen may reciprocally moves along the non-closed rail, and the movement period of the screen is matching with the interval time between two adjacent riding vehicles. When a non-closed screen rail 4 is employed, the screen 3 is capable of performing a 180° pitching motion via a pitch axis (i.e., reversal motion) to adapt its self with the synchronous traveling with the riding vehicle. When riding vehicle 1 is in the form of two vehicles/line, the moving screen 3 is also in the form of two screens/line.

In view of above, the present disclosure combines the experiences of a stimulating section and a non-stimulating section in one experience system, so as to satisfy different tourists' demands for different stimulating degrees, and thereby broaden the audience scope of the entertainment project. Network lines can be formed by the crossing and intersecting of different lines, which can significantly improve the space utilization of the entertainment facilities. By employing a moving screen synchronously traveling with the riding vehicle, the tourists may engage into the dynamic scenes during the traveling process, which substantially alters the previous experience mode of stopping for watching movies or interacting with scenes.

The invention claimed is:

1. An amusement-oriented multi-mode experience system comprising a closed rail and a riding vehicle traveling along the closed rail, wherein a screen rail is provided at a side of the closed rail, a screen synchronous moving mechanism corresponding to the riding vehicle and capable of traveling is provided on the screen rail, the screen synchronous moving mechanism comprises a rotary support device and a traveling device, a screen installed on the top of the rotary support device, wherein the screen is capable of performing a 180° pitching motion via a pitch axis, and wherein the rotary support device is installed on the traveling device and is capable of performing a 360° rotation in a horizontal plane, and wherein the traveling device can travel along with the riding vehicle synchronously on the screen rail.

2. The amusement-oriented multi-mode experience system of claim 1, wherein the screen rail is in a closed shape and is in parallel with the closed rail.

3. The amusement-oriented multi-mode experience system of claim 1, wherein the screen rail is in a straight line shape and is disposed within the closed rail.

4. The amusement-oriented multi-mode experience system of claim 1, wherein the screen is a straight screen, an arc screen, a dome screen, an irregular screen or a fog screen.

5. The amusement-oriented multi-mode experience system of claim 1, wherein the riding vehicle comprises a wheel-type chassis adapted for traveling along the closed rail and a tourist cabin mounted on the wheel-type chassis.

6. The amusement-oriented multi-mode experience system of claim 5, wherein the tourist cabin is rotatably and retractably mounted on the wheel-type chassis via a support equipment.

7. The amusement-oriented multi-mode experience system of claim 1, wherein the closed rail comprises a stimulating section and a non-stimulating section.

8. The amusement-oriented multi-mode experience system of claim 7, wherein a rail switching device is mounted at a bifurcation and an intersection of the stimulating section and the non-stimulating section, and the rail switching device comprises a straight rail, a curve rail, a connector, a slide rail, and a driving and controlling device, which can be assembled together into one piece being capable of lateral motion as a whole.

9. The amusement-oriented multi-mode experience system of claim 1, wherein one or both of a static scene and a dynamic scene are disposed on a side of the closed rail.

* * * * *